United States Patent [19]

Stack

[11] 3,954,667

[45] May 4, 1976

[54] COMBUSTION CATALYST FOR PROPELLANTS

[75] Inventor: Joseph S. Stack, Riverdale, N.J.

[73] Assignee: The United States of America as represented by the Secretary of the Army, Washington, D.C.

[22] Filed: Dec. 14, 1973

[21] Appl. No.: 423,366

Related U.S. Application Data

[62] Division of Ser. No. 56,018, July 1, 1970.

[52] U.S. Cl. ..... 252/431 N; 252/428; 252/438; 149/98

[51] Int. Cl.[2] ..... B01J 31/12

[58] Field of Search ..... 252/428, 430, 431 N, 252/438; 149/92, 98

[56] References Cited

UNITED STATES PATENTS

| | | | |
|---|---|---|---|
| 3,033,718 | 5/1962 | Preckel | 149/100 |
| 3,445,306 | 5/1969 | Satriana | 149/100 |

*Primary Examiner*—Stephen J. Lechert, Jr.
*Attorney, Agent, or Firm*—Nathan Edelberg; Robert P. Gibson; A. Victor Erkkila

[57] ABSTRACT

Double-based propellant combustion catalysts such as lead stannate-tolylene diisocyanate(reduced) are extremely effective in lowering the temperature dependency of burning rate with pressure of smokeless propellants irrespective of their crossed or uncrossed linkages.

7 Claims, 17 Drawing Figures

COMBUSTION CATALYST FOR PROPELLANTS

The invention described herein may be manufactured, used, and licensed by or for the Government for governmental purposes without the payment to me of any royalty thereon.

This is a division of application Ser. No. 56,018 filed 1 July 1970.

This invention relates to propellants and more particularly concerns vastly improved modifiers or combustion catalysts for smokeless, high-energy propellants containing nitramines, although not limited thereto.

A most desirable characteristic of any propellant system is reliability of performance which is dependent upon many factors, one being its ballistic properties. A major factor in promoting dependable ballistic properties is the successful development of propellants with burning rates which are invariant or nearly invariant to changes in pressure and temperature. In this respect, desirable isotherms are of negative or zero slope (mesa and plateau burning) and are only slightly temperature dependent (low temperature coefficients, $\pi p$. %/°F).

In the pase, almost exclusively, metalo-organo and inorganic compounds of lead with chelated derivatives were found to be most effective as ballistic modifiers for double-base propellants. Because of current demands for higher energy propellants, greater emphasis is now being placed on the development of combustion catalysts which are effective at high energy levels. Propellants of this type are vital in close-support weapon systems where performance reliability and smokelessness are prime requirements, and include, among others, the nitramine (RDX, HMX) nitrocellulose base propellants of high volumetric impulse of the following types: extruded smokeless nitramine double-base propellants; plastisol (cast type) smokeless nitramine double-base propellants, and the like.

Prior efforts to ballistically modify these propellants with modifiers employed in the straight double-base systems (metalo organic and inorganic salts) met with limited success and resulted in minimum acceptable "straight line" ballistics for these systems. Even though the effectiveness of modification was minimal for these propellant types, most efficient ballistic modification was obtained with solvent extruded type systems containing metalo organic and inorganic salts. Plastisol (cast type) systems which employ Fluid Ball Powder, to be hereinafter described, as the polymeric binder, resisted nearly all attempts at ballistic modification. For this system, lead stannate hydrate was found to be the most effective combustion catalyst. Cross-linked plastisol (cast type) propellants resisted all ballistic modification with currently known combustion catalysts.

Fluid Ball Powders, trademark products of Olin Mathieson Chemical Corporation, used in the formulation of many of my inventive products, having an average particle size of about 7 microns, have the following compositions:

TABLE I

| Composition of Fluid Ball Powder | Type B | Type C |
|---|---|---|
| Nitrocellulose, 12.6%N, % | 90.0 | 74.0 |
| Nitroglycerin, % | 8.0 | 24.0 |
| 2-Nitrodiphenylamino, % | 2.0 | 2.0 |
| Dioctylphthalate, added, % | 0.2 | 0.1 |
| Carbon black, added % | 0.01 to 0.3 | — |

It would be most advantageous if new combustion catalysts for cross-linked and uncross-linked high energy smokeless nitramine double-base propellants could be developed which would impart improved and unique ballistic quality of invariance of burning rate to changing temperature and pressure conditions thereto.

It is therefore an object of this invention to provide a new and improved general class of propellants.

Another object of the invention is to provide new propellant compositions containing combustion catalysts or modifiers therein which reduce burning rate dependency of the propellant to variations of pressure and temperature.

Still another object of the invention is to provide propellants as aforedescribed of nitrocellulose and nitramines of generally high energy type although not limited thereto.

A still further object of the inventon is to provide propellants as aforedescribed which are amenable to the plastisol, solvent-extruded, solvent-solventless and solventless processes.

Other and further objects of the invention will be apparent to those skilled in the art upon study of this disclosure and the drawings which graphically represent various and pertinent ballistic properties of propellants as thereon described.

Figure 1:
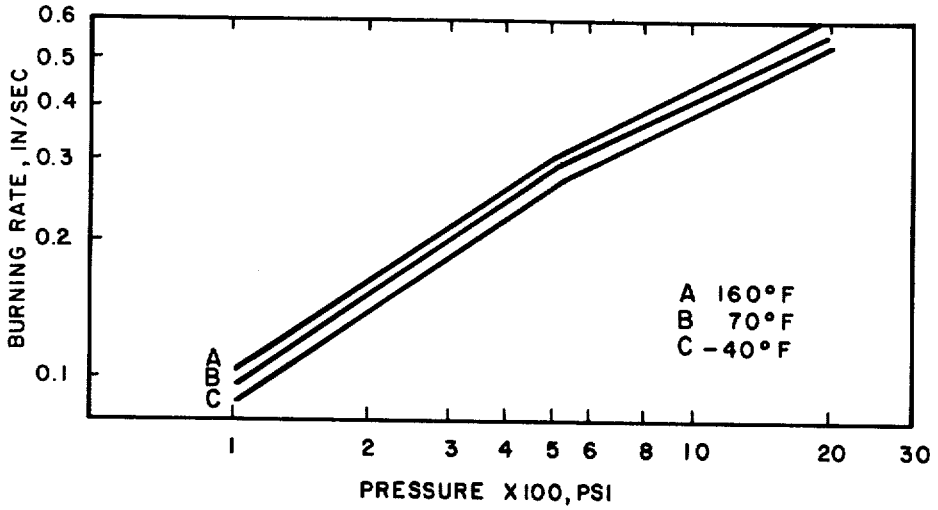
FIGS. 1, 2, 9 and 10 show the burning rate properties of double-base propellants containing RDX or HMX with prior art or unsatisfactory catalysts.

In accordance with the above objects, cross-linked and uncross-linked smokeless nitramine containing plastisol propellants were prepared by processes, one of which is illustrated below:

1. To casting solvent, hereinafter described, add resorcinol (if required) and Type B Fluid Ball Powder and let stand overnite at 70°F. to form a mixture.
2. Add resultant mixture to suitable mixer, such as vertical sigma blade mixer.
3. Add HMX (tetramethylene tetranitramine), modifier, quick gel (Type C) Fluid Ball Powder and 2, 4-tolylene diisocyanate (if required) with mixing between additions.
4. Mix for approximately two hours at 25.50°C at a vacuum of 2–10mm Hg.
5. Cast at a viscosity of approximately 30,000 cps and cure at 60°C for 3 days.

TABLE II

| Composition of Casting Solvent | wt. % |
|---|---|
| Triethylene glycol dinitrate | 65.0 |
| Butane triol trinitrate | 34.0 |
| 2-Nitrodiphenylamine | 1.0 |

In preparing extruded smokeless nitramine containing double-base propellants, the usual solvent-extruded techniques are employed. Mixing is suitably performed in a horizontal sigma blade mixer and the propellants solventextruded and air dried.

Other materials used in my inventive formulations, and methods describing their preparation where deemed necessary are:

TABLE III

| |
|---|
| HMX: average particle size of 2 microns and 180 microns |
| RDX (trimethylenetrimitramide): average particle size 14 microns |
| Nitroglycerine |
| Nitrocellulose 12.6% N |
| TDI (2,4-tolylene diisocyanate) |
| Lead stannate (hydrate) |
| Lead stannate-TDI complex: |

1. Add lead stannate hydrate to an excess of 2, 4-tolylene diisocyanate in increments while mass is being agitated.
2. Mix for 1 hour at 25° to 55°C.
3. Filter and wash filter cake once with acetone.
4. Place filter cake in suitable container, add acetone and agitate for 10 minutes and filter.
5. Repeat step (4) three or four times.
6. Dry filtercake for 3 hours at 100°C.

The lead stannate-TDI complex in (6) should contain about 17–25% organic matter as determined by sintering a sample of the complex in air at about 500° ± 25°C for about 1 hour.

Lead stannate TDI (Oxidized):

1. Place lead stannate — TDI complex obtained above in a suitable container and heat at 500° ± 25°C in a muffle furnace with door ajar until decomposition is complete (decomposition is complete when smoking ceases). *Decomposition should not be accompanied by flame.*
2. Immediately after decomposition is complete (smoking ceases), close vent on vessel containing modifier and heat at 500°C ± 25°C in the absence of air for approximately one half hour. (Covering container containing modifier with aluminum foil was found suitable).
3. After heating is completed, remove covered container with lead stannate TDI (reduced) from muffle furnace and let cool overnight at ambient temperature.
4. Screen lead stannate-TDI (reduced) through 400 mesh sieve.

Cupric salicylate
Lead beta resorcylate
Carbon black
Resorcinol
2-nitrodiphenylamine
Triacetin By way of further explanation, the lead-stannate-TDI complex aforedescribed is a product of reaction between lead stannate hydrate and 2,4-tolylene diisocyanate, the organic fraction of the complex being an isocyanate terminated disubstituted urea. The lead stannate-TDI (oxidized) catalyst is formed by heating the lead stannate-TDI complex at 500° ± 25°C in the presence of air. This product consists essentially of lead oxide (yellow) and stannic oxide with a trace quantity of an ammono plumbate or tin complex of unknown structure. The lead stannate-TDI (reduced) is prepared by heating the lead stannate-TDI complex essentially in the absence of air at 500°C ± 25°C. This combustion catalyst is comprised of carbon, finely divided metallic lead, lead oxide, stannic oxide and some ammono plumbate or tin complex of unknown structure.

Reactions for formation of the lead stannate-TDI complex and TDI (oxidized) and TDI (reduced) forms of lead stannate are indicated below:

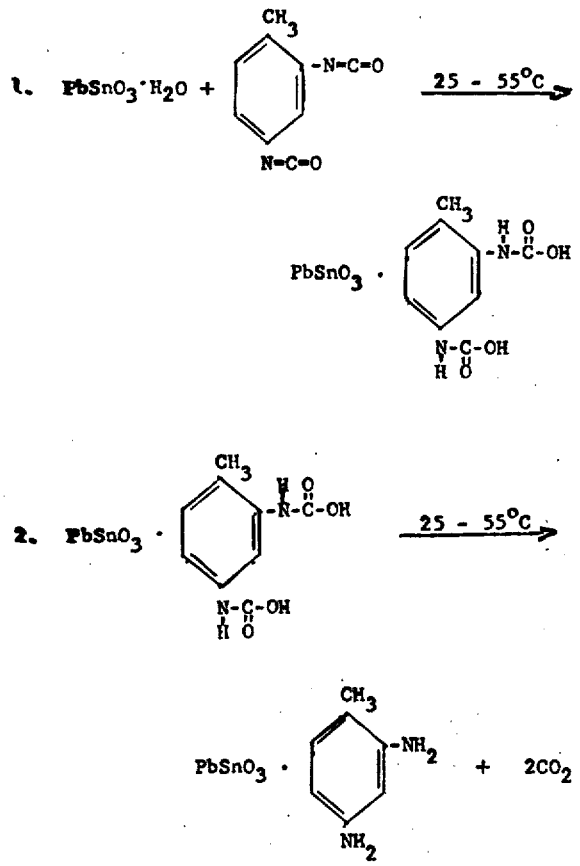

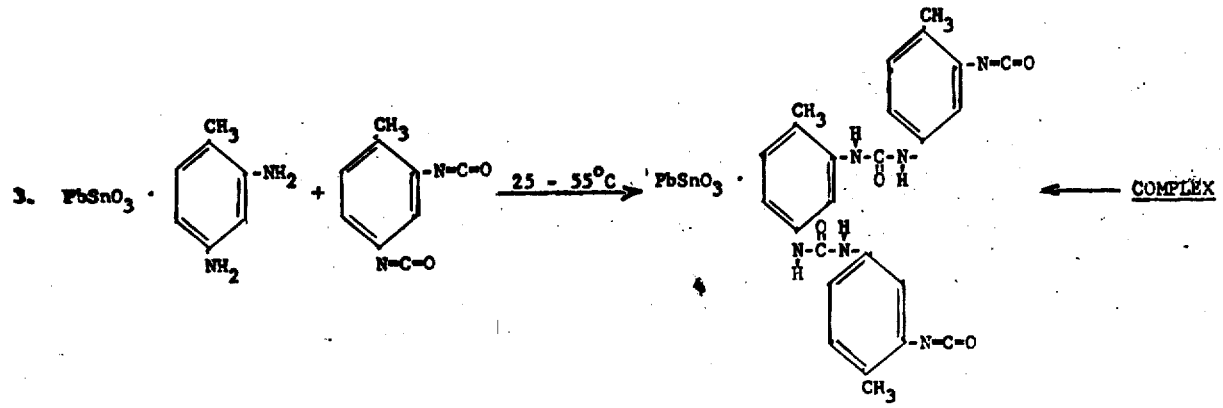

4. $PbSnO_3$ ·

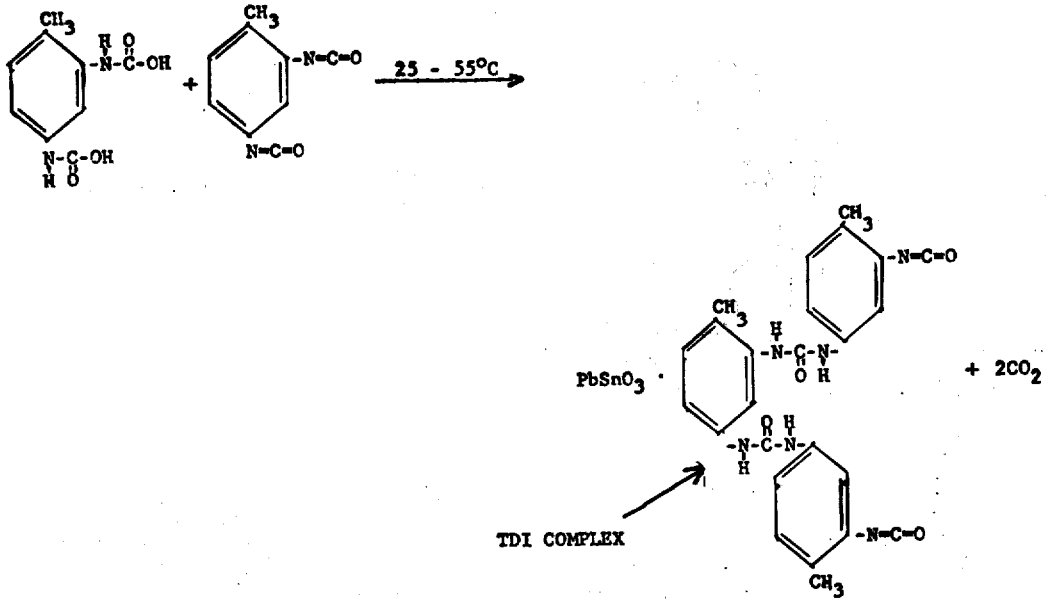

REACTION FOR FORMATION OF LEAD STANNATE
(2-4, TOLYLENE DIISOCYANATE OXIDIZED)

1. $PbSnO_3$ ·

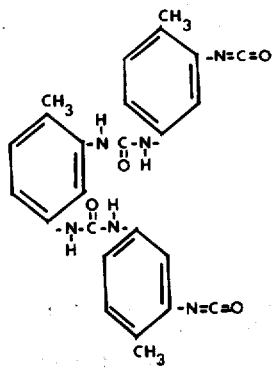

500° ± 25°C $2CO_2 + 2CO + 21C + 4NH_3 + H_2O$
+ Pb + PbO + SnO2 + ammonium plumbate or tin complex of unknown structure 2. Pb + PbO + $SnO_2$ + Ammonium plumbate + 21C or tin complex of unknown structure Air
500° ± 25°C

*
$2PbO + SnO_2 + 21CO_2 + 2NH_3 + H_2O$

LEAD STANNATE
TDI (OXIDIZED)
*Trace quantities of ammonium plumbate or tin complex of unknown structure -continued

REACTION FOR FORMATION OF LEAD STANNATE
(2-4, TOLYLENE DIISOCYANATE OXIDIZED)

| | | | |
|---|---|---|---|
| 1. $PbSnO_3$ . | 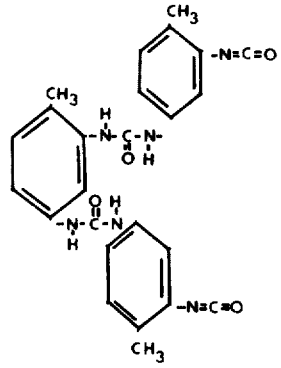 | (No Air) 500 ± 25°C | $4CO + 6NH_3 + 21C + 4H + PbSnO_3$ |
| 2. $2PbSnO_3 + 4CO + 6NH_3 + 21C + 4H$ | | (No Air) 500 ± 25°C | $2CO_2 + 2CO + NH_3 + H_2O$<br>$21C + Pb + PbO + SnO_2$ + Ammonium plumbate or tin complex of unknown structure<br>LEAD STANNATE<br>TDI (Reduced) |

TABLE IV

BALLISTIC MODIFIER ANALYSIS AND THERMOCHEMICAL PROPERTIES

| | I R ANALYSIS | | | | X-RAY DIFFRACTION | | | |
|---|---|---|---|---|---|---|---|---|
| | $H_2O$ | $H-N-\overset{O}{\overset{\|\|}{C}}-N$ | $N=N$ | $C=O$ | Amine | $PbSnO_3$ | Pb | PbO | $SnO_2$ |
| Lead Stannate (as received) | X | O | O | O | X | O | O | O |
| Lead Stannate heated at 450–500°C for one hour | X | O | O | O | X | O | O | O |
| Lead Stannate-TDI Complex | X | X | X | X | X | O | O | O |
| Lead Stannate TDI (reduced) * | X | O | O | X | O | X | X | X |
| Lead Stannate TDI (oxidized) * | X | O | O | X | O | O | X | X |

| | CHEMICAL ANALYSIS | | | | | THERMOCHEMICAL PROPERTIES |
|---|---|---|---|---|---|---|
| | Pb.% | Sn. % | (b) $O_2$,% | (c) Consumables, % | Total, % | HEAT OF COMBUSTION, Cal/g |
| Lead Stannate (as received) | 55.63 | 31.8 | 12.8 | — | 100.2 | 159.9 |
| Lead Stannate heated at 450–500°C for one hour | — | — | — | — | — | 102.0 |
| Lead Stannate-TDI Complex | 42.02 | 23.43 | 12.8 | 22.8 | 101.3 | 209.8 |
| Lead Stannate TDI (reduced) * | — | — | — | — | — | 544.7 |
| Lead Stannate TDI (oxidized) * | 58.10 | 24.29 | 12.8 | — | 95.19 | 49.3 |

(a) All modifiers screened through 400 Mesh sieve
(b) Theoretical
(c) Includes $H_2O$ and organic matter
X - Presence indicated
O - not indicated
* - IR Analysis indicates Amine present Several studies on extruded type of propellants were performed. Two of the more promising involved 54 and 56% RDX and HMX respectively.

Figure 2:
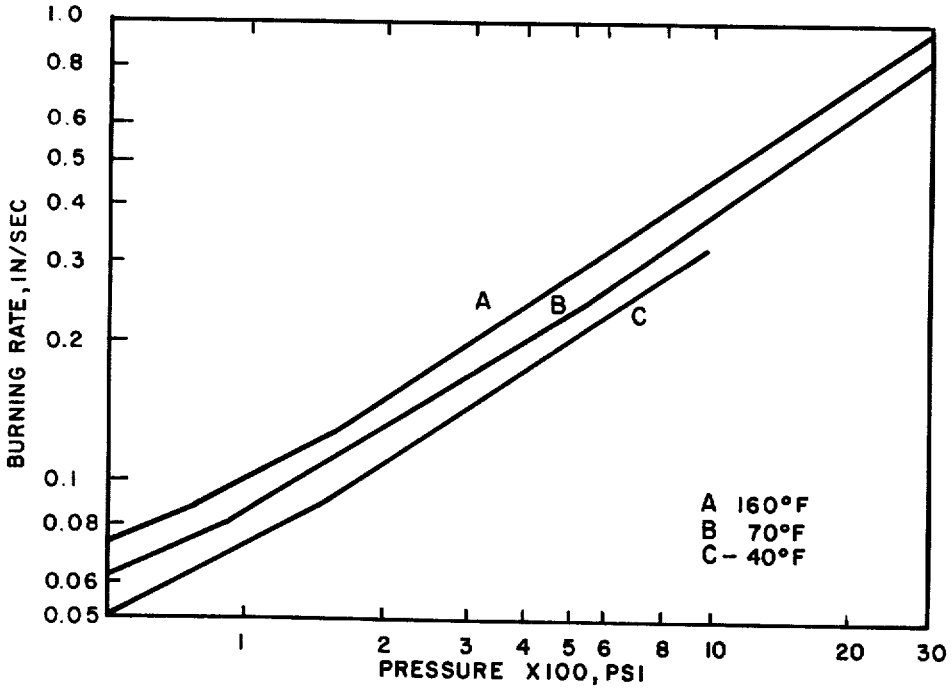

Ballistic results with the 54% RDX and 56% HMX systems show that optimum properties were achieved with a combination of cupric salicylate and lead beta resorcylate as modifiers. These data are shown in FIGS. 1 and 2. Pressure exponents exhibited by these systems were 0.48 (530–2000 psi) and 0.71 (500–3000 psi) respectively and temperature coefficients of pressure at 1000 psi (p/r of 2500 and 2700) of 0.16 and 0.44 between 160 and −40°F. Though the ballistic properties of these systems were considered the "best" that could be realized with a large number of known modifiers, it is apparent that significant improvement of many properties is still necessary. In addition, these data vividly indicate the difficulty in effectively modifying ballistics of high energy smokeless nitramine double-base propellants by known modifiers. Pertinent data for each of the 17 FIGS. are presented hereinafter.

Figure 3:
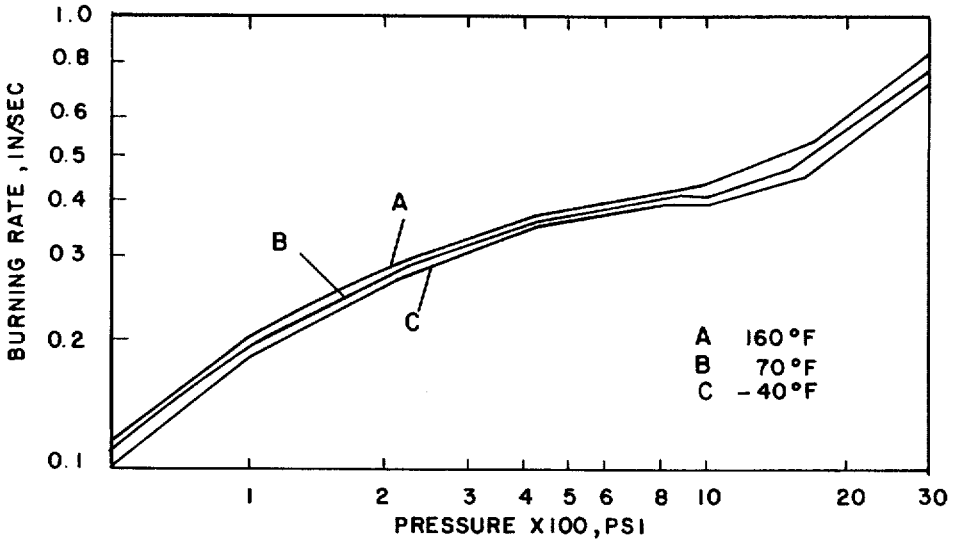
FIGS. 3–8 and 11–17 show the burning rate properties of double-base propellants containing RDX or HMX with various combustion catalysts of the invention.
Figure 4:
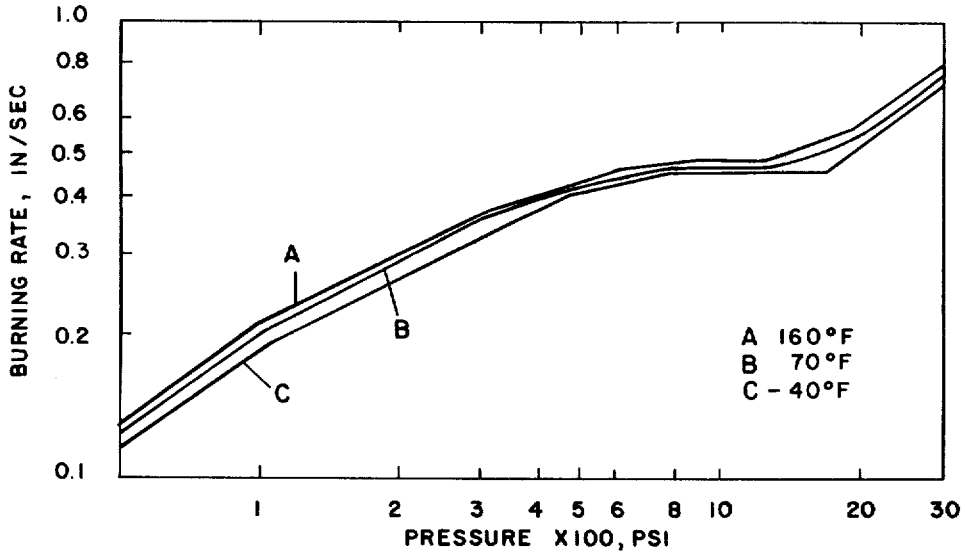
Figure 5:
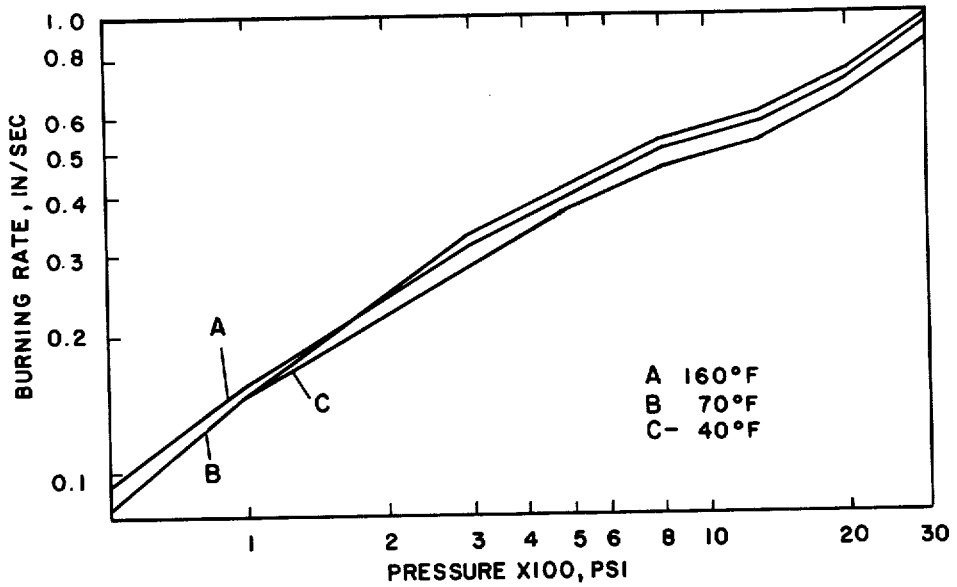
Figure 6:
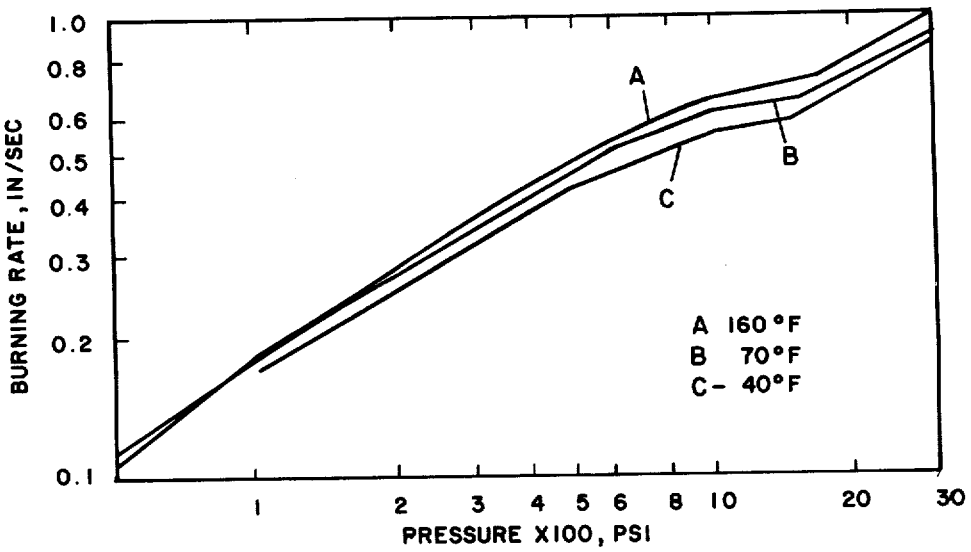
Figure 7:
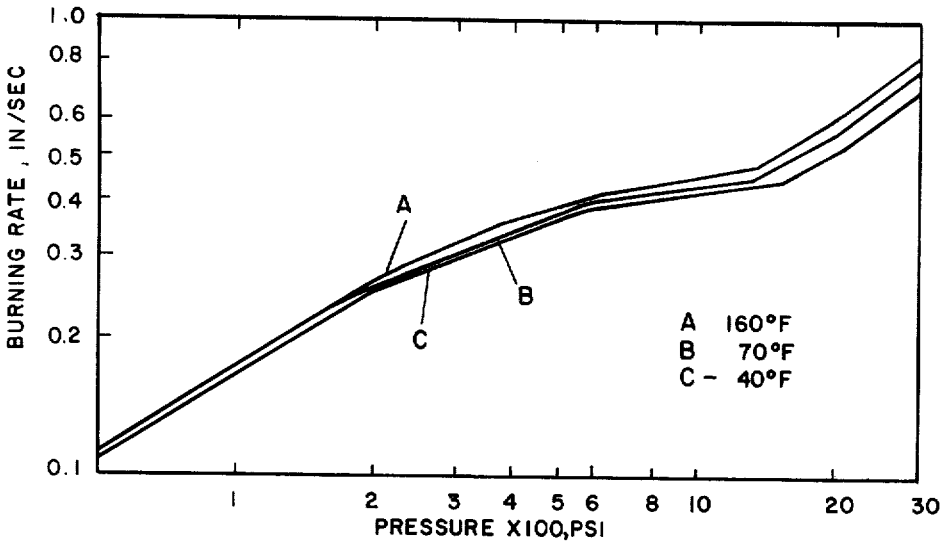
Figure 8:
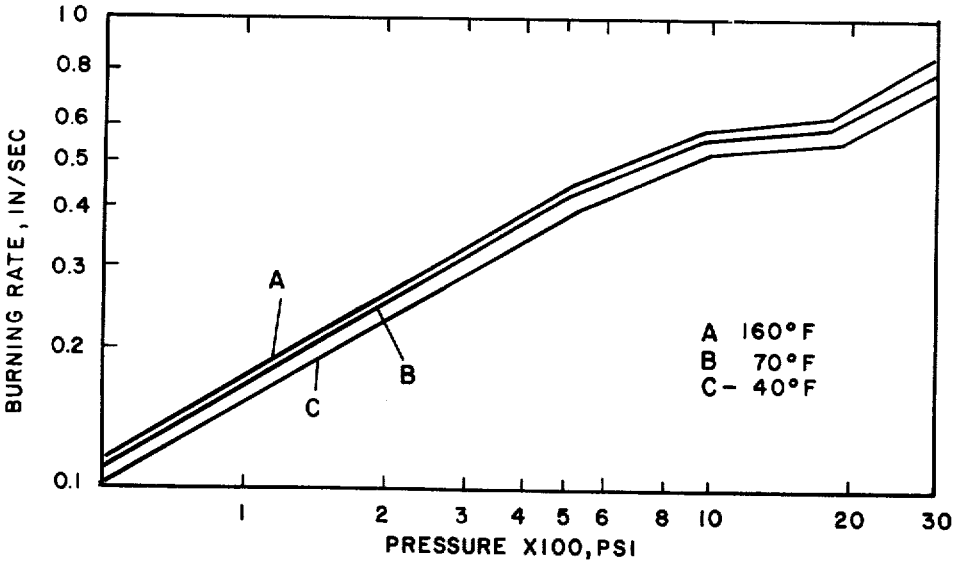

In evaluating my new combustion catalysts in these systems, a direct substitution was made for prior modifiers employed. The RDX system modified with lead stannate — TDI (oxidized) and lead stannate — TDI (reduced) revealed a vast reduction in the temperature dependency of burning rate with pressure. The data, shown in FIGS. 3 and 4, indicate that, of the two catalysts, the TDI reduced form of lead stannate was the more effective combustion catalyst. The system with the TDI oxidized form of lead stannate had a pressure exponent, "$n$" 0.40, (1000–1700 psi) and a temperature coefficient of pressure ($\pi$p,%/°F) of 0.045 between 160 and −40°F. The propellants with the TDI-reduced catalyst had an increased burning rate and plateau ballistics, ("$n$" 0.00 (8000–1200 psi), with a temperature coefficient of pressure ($\pi$p,%/°F) of 0.02 (1000 psi, p/r 2080) between 160° and −40°F.

Further evaluations were made of the two new combustion catalysts in 56% HMX compositions containing bimodal distributions of filler (75% 180$\mu$ and 25% 2$\mu$) and all fine HMX of $\mu$ average particle size. Strand burning rate data for these systems, shown in FIGS. 5 thru 8, indicate that both the combustion catalysts, lead stannate-TDI (oxidized) and lead stannate-TDI (reduced) were highly effective in improving ballistic properties of these propellants.

In comparing strand burning rate data, systems with fine particle size HMX exhibited lower pressure exponents and lower temperature coefficients of pressure than similar propellants containing the bimodal distribution of HMX abovementioned. For systems modified with lead stannate-TDI (oxidized) and containing bimodal distributions and all fine HMX, the ballistic properties were as follows: pressure exponents, "$n$", at 70°F, 0.23 (800–1300 psi) and 0.11 (600–1300 psi) respectively, whereas the temperature coefficients of pressure ($\pi$p,%/°F) at 1000 psi (p/r 1920 and 2380) were 0.09 and 0.05 between 160°F and −40°F. For similar systems modified with lead stannate-TDI (reduced) the pressure exponents at 70°F were 0.14 (1000–1500 psi) and 0.08 (1000–1800 psi) respectively. The temperature coefficients of pressure at 1000 psi (p/r 1650 and 1850) were 0.12 and 0.07 over a temperature range of 160°F to −40° F.

Data abovedescribed indicate the effectiveness of my new combustion catalysts, lead-stannate-TDI (oxidized) and lead stannate-TDI (reduced) as ballistic modifiers for extruded type high energy smokeless RDX and HMX containing double-base propellants with varying calorific levels.

My RDX and HMX ranges are not limited to those aforementioned. I have found that the RDX or HMX, alone or in combination, may range from about 1 to 70 weight percent. The balance of the propellant is not limited to nitroglycerine, as can be seen from Tables I and II supra. Nor is my invention limited to RDX and HMX nitramines but others such as ethylene dinitramine, diethanolnitramine dinitrate, and the like may benefit from incorporating my catalysts therewith.

Although many specific examples are cited on the drawings, a double base propellant containing around 30% HMX with the balance being a Fluid Ball modifier, casting solvent, and lead stannate-TDI (reduced) would ordinarily yield plateau ballistics whereas an increase in the HMX content above 30% will yield mesa ballistics.

Fluid Ball Powder, Type C, may range effectively between about 0 to 1.0% whereas Type B is effective in larger amounts, generally ranging between about 6 to 50%. Casting solvent ranges have been found effective as low as about 25% to about 68% whereas my modifier can range between about 1 to 7%.

To illustrate the variations in Fluid Ball and nitramines, two specific examples are herein presented:

EXAMPLE I

| | |
|---|---|
| Nitramine | 50 wt.% |
| Fluid Ball, Type B | 5 |
| Modifier, TDI (reduced) | 2 |
| Casting Solvent | 40 |

EXAMPLE II

| | |
|---|---|
| Nitramine | 5 wt.% |
| Fluid Ball, Type C | 1 |
| Fluid Ball, Type B | 45 |
| Modifier, TDI (oxidized) | 4 |
| Casting Solvent | 45 |

It is not necessary that Type C, Fluid Ball be present in any of our propellant compositions, since it functions merely as a viscosity control agent.

There are other nitrocellulosic binder materials, irrespective of nitrogen content which may be used advantageously with my invention. For example, a Fluid Ball Powder comprising about 74 to 100% nitrocellulose, the remainder, if any, being a stabilizer such as 2-nitrodiphenylamine, and energetic liquid nitrate esters such as nitroglycerine, butane triol trinitrate, triethylene glycol dinitrate, metriol trinitrate, and the like, may be used beneficially.

Plastisol propellants, because of their nature, (cast type of low viscosity) are generally made in a vertical type of sigma blade mixer which essentially provides for intimate mixing of the propellant ingredients without efficiently colloiding the Fluid Ball Powder binder material incorporated therewith. Colloiding will occur between the high energy plasticizer and Fluid Ball Powder principally during the propellant cure cycle, thereby inhibiting thorough distribution of the solvated or colloided portion of the Fluid Ball Powder throughout the propellant matrix. As a result of these physical deficiencies, ballistic modification of these systems is difficult. The cross-linking of the plastisol type propellants with 2, 4-tolylenediisocyanate further complicates ballistic modification. Cross-linking of these propellants is essential if mechanical properties thereof are to be improved. However, during the cross-linking process, side reactions often occur between diisocyanate cross-linkers and metalo organo and inorganic salts which diminish the desirable effectiveness of ballistic modifiers in these systems.

Figure 9:
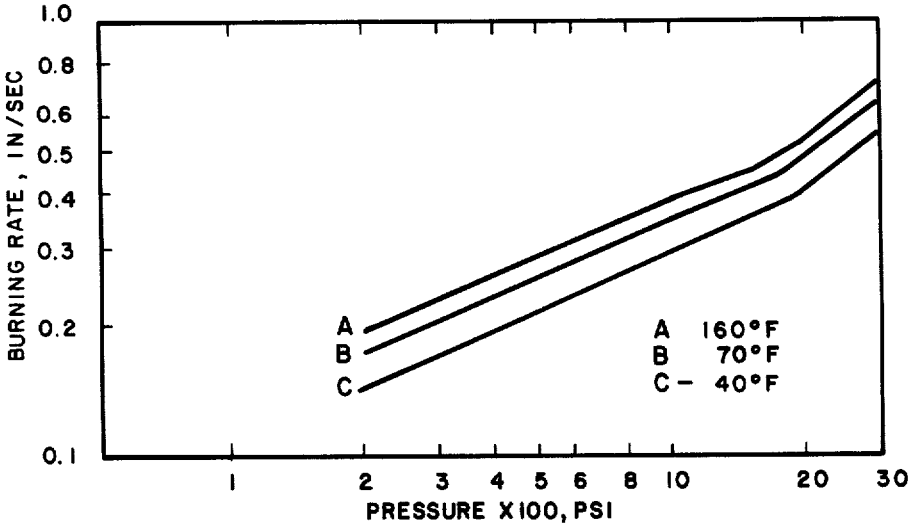
Figure 10:
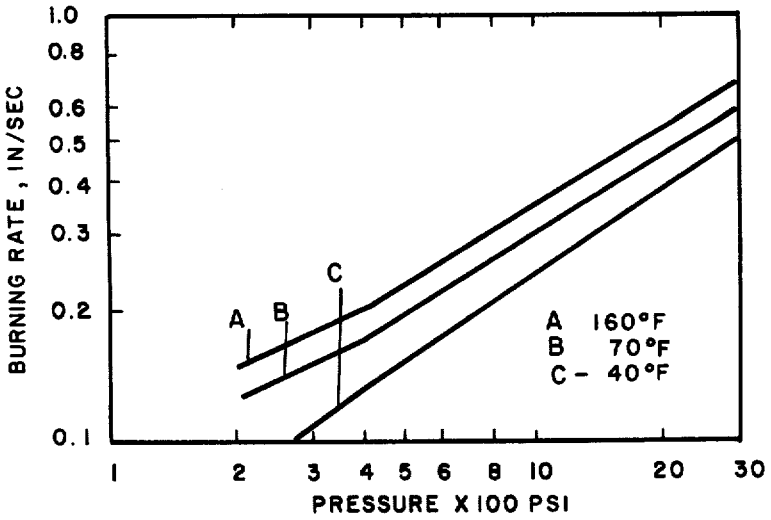

Typical burning rate data for uncross-linked and cross-linked high energy smokeless nitramine double-base propellants ballistically modified with lead stannate hydrate are shown in FIGS. 9 and 10. For the uncross-linked system, straight line ballistics are indicated with a pressure exponent, "$n$", at 70°F of 0.40 (1000–1800 psi) and temperature coefficient of pressure, $\pi$p,%F of 0.23 at 1000 psi (p/r 2500) between 160° and −40°F. The burning rate data for the cross-linked propellant show a decided degradation of ballistic properties as opposed to the uncross-linked system. Straight lines ballistics are indicated with a pressure exponent, "$n$", at 70°F of 0.61 (400–3000 psi) and temperature coefficient of pressure, $\pi$p,%/°F, of 0.44 at 1000 psi (p/r 3330) between 160° and −40°F. These data vividly illustrate the problem associated with ballistic modification of cross-linked plastisol propellants.

Lead stannate hydrate (heated at 450°–500°C), lead stannate-TDI complex, lead stannate TDI (oxidized) and lead stannate-TDI (reduced) were evaluated in order to determine their effectiveness as ballistic modifiers in plastisol propellants.

Figure 11:
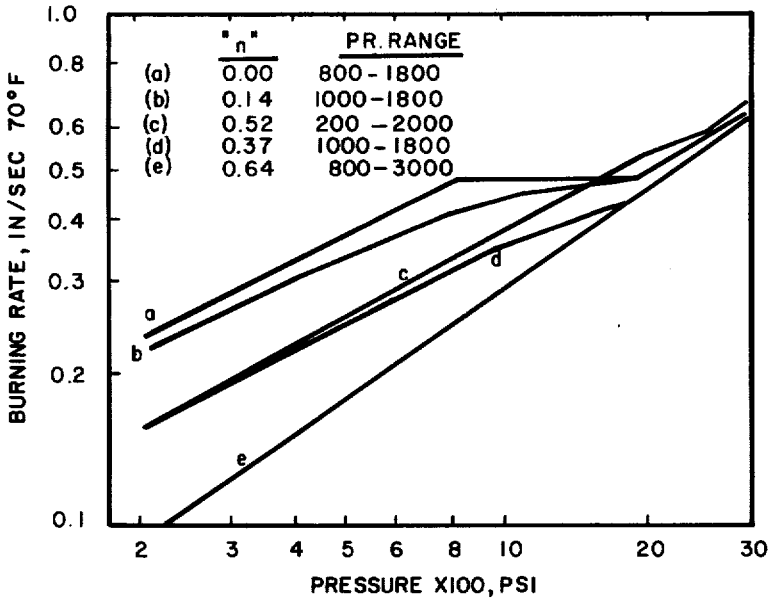
Figure 12:
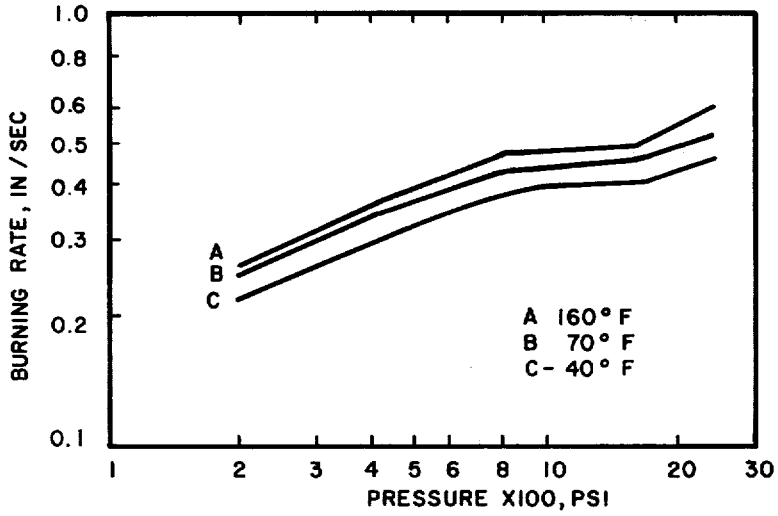
Figure 13:
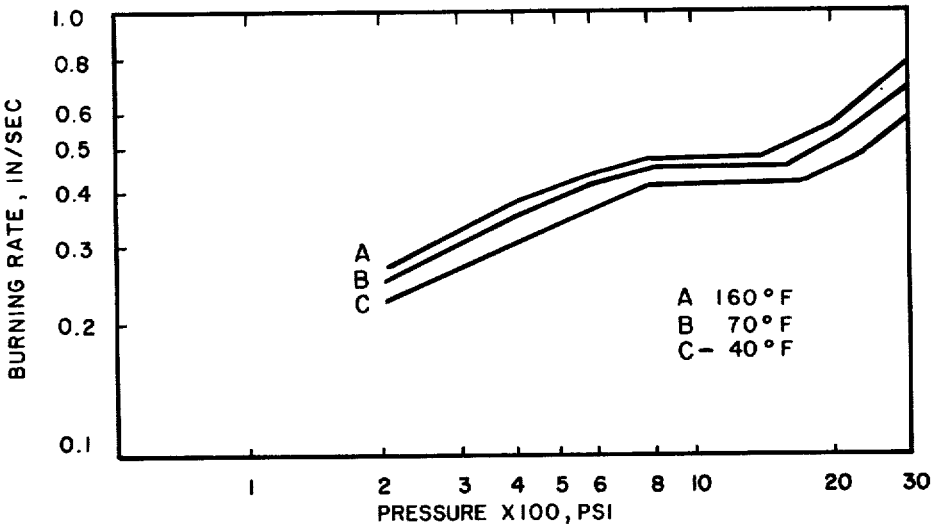

Strand burning rate studies shown in FIG. 11 indicate that two of these combustion catalysts, lead stannate-TDI (oxidized) and lead stannate-TDI (reduced) were highly effective in reducing dependency of burning rates with pressure for the uncross-linked plastisol nitramine double-base propellants. Systems with heat treated lead stannate hydrate exhibited only minimum acceptable "straight line" ballistics, while the lead stannate-TDI complex offered little promise as a ballistic modifier in these propellants.

FIGS. 12 thru 15 indicate the ballistic properties of uncross-linked and cross-linked plastisol type propellant systems effectively modified with lead stannate-TDI (oxidized) and lead stannate-TDI (reduced). The uncross-linked systems exhibited burning rates which were near invariant to changes in pressure and temperature. Pressure exponents, "$n$", were 0.06 and 0.00 (800–1600 psi) respectively and temperature coefficients of pressure, $\pi p$,%/F, of 0.11 and 0.07 at 1000 psi between 160° and −40°F. Only cross-linked propellants are so labeled in the heading of the drawings.

Figure 14:
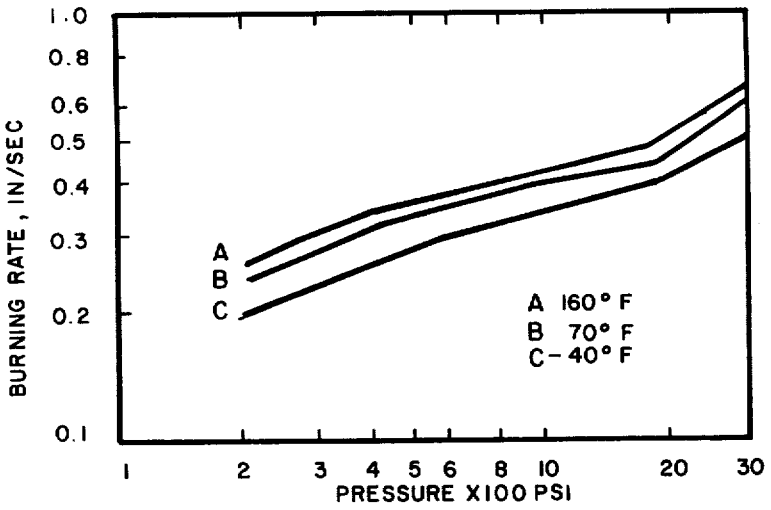
Figure 15:
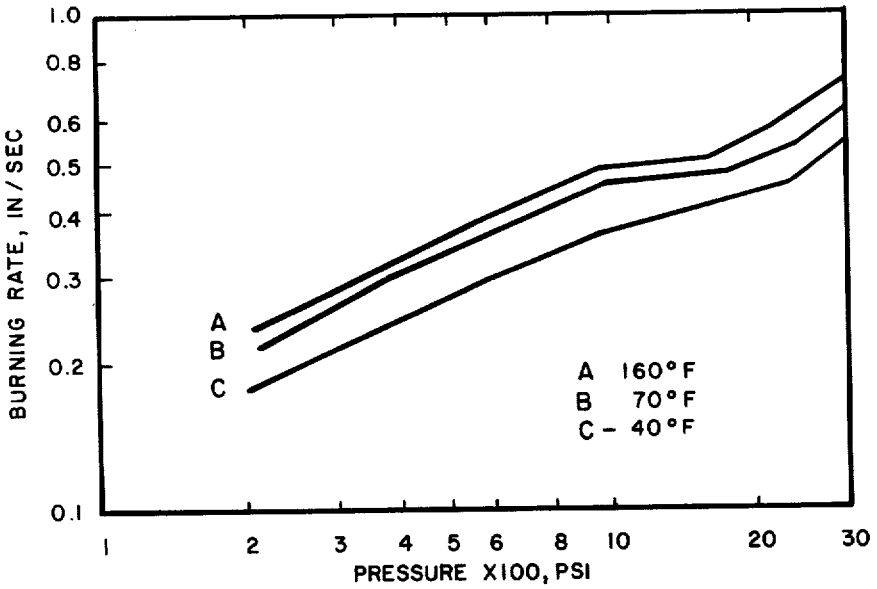

The cross-linked systems, shown in FIGS. 14 and 15 also exhibited admirable ballistic qualities. Pressure exponents, "$n$" were 0.10 and 0.16 (1000–1800 psi) and temperature coefficient of pressure ($\pi p$,%/°F) at 1000 psi were 0.22 and 0.14 (p/r 2200 and 2500) between 160° and −40°F. Improvements in these properties were not as marked as with the uncross-linked systems. However, the major improvement in ballistic properties over prior cross-linked systems is considered a true advancement in the art.

Figure 16:
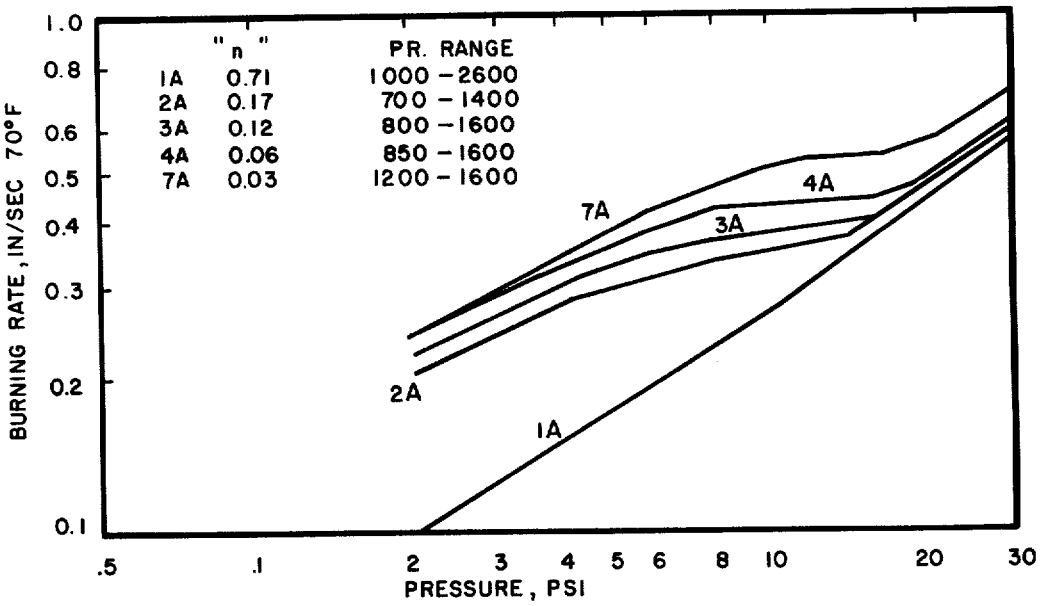
Figure 17:
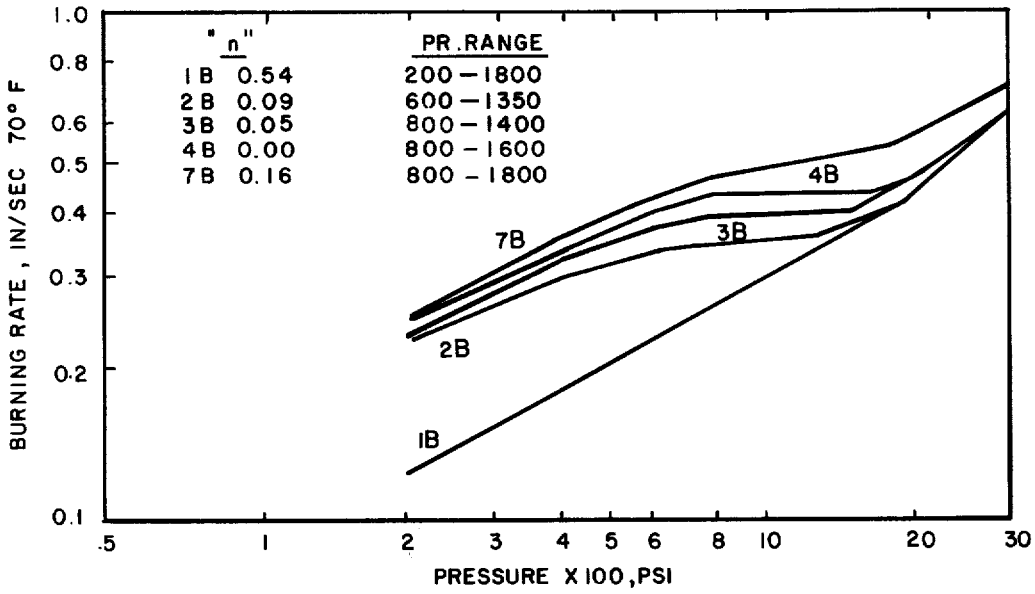

FIGS. 16 and 17 show the variations in pressure exponent, "$n$", when lead-stannate — TDI (oxidized) and lead stannate — TDI (reduced) are increased from 1 to 7 percent of the weight of the final propellant.

It is apparent from the above description that I have provided new combustion catalysts which are extremely effective in reducing the variability of burning rate to temperature and pressure of high energy (230–240 lb-sec/lb) nitrocellulose based smokeless nitramine uncross-linked and cross-linked rocket propellant formulations, made by the plastisol, extruded, solvent-solventless and solventless processes. Propellants with my new combustion catalysts have displayed very low variation in burning rate to temperatures (160°F to −40°F) and pressure over useful pressure ranges (plateau ballistics and low temperature coefficients). Further, my catalysts are applicable to low and intermediate energy systems (low energy, Q, Heat of Explosion 200–800 cal/g; intermediate energy, Q, Heat of Explosion, 800–900 cal/g) as well as high energy systems as abovedescribed. My catalysts should find use in rocket systems, gun systems and in propulsion systems for close support missions where high performance and reliability over temperature extremes is needed.

Data for the 17 FIGS. are presented below:

DATA RELATING TO FIG. 1

| INGREDIENTS | PERCENT COMPOSITION |
|---|---|
| Nitrocellulose, 12.6% N | 19.9 |
| Nitroglycerin | 16.7 |
| RDX, 14μ | 54.0 |
| Triacetin | 4.2 |
| 2-Nitrodiphenylamine | 1.0 |
| Lead betaresorcylate | 2.1 |
| Cupric salicylate | 2.1 |
| Carbon black, added | 0.03 |

Heat of Explosion, cal/gm
Measured Value 1104

| —P, at Constant p/r from −40°F to 160°F | Pressure Exponent, 70°F Press. range psi | Slope, "n" |
|---|---|---|
| | 530–2000 | 0.48 |

| Press. at 70°F | p/r | p, %/°F |
|---|---|---|
| 1000 | 2500 | 0.16 |

DATA RELATING TO FIG. 2

| INGREDIENTS | PERCENT COMPOSITION |
|---|---|
| Nitrocellulose, 12.6% N | 20.0 |
| Nitroglycerin | 15.0 |
| HMK: 75% 180 micron, 25% 2 micron | 56.0 |
| Triacetin | 4.0 |
| 2-Nitrodiphenylamine | 1.0 |
| Lead betaresorcylate | 2.0 |
| Cupric salicylate | 2.0 |
| Carbon black, added | 0.03 |

Heat of Explosion, cal/gm
Measured Value 1121

| πp at Constant p/r From −40°F to 160°F | Pressure Exponent, 70°F Press. range, psi | Slope, "n" |
|---|---|---|
| | 500–3000 | 0.71 |

| Press. at 70°F | p/r | πp, %/°F |
|---|---|---|
| 1000 | 2700 | 0.44 |

DATA RELATING TO FIG. 3

| INGREDIENTS | PERCENT COMPOSITION |
|---|---|
| Nitrocellulose, 12.6% N | 19.9 |
| Nitroglycerin | 16.7 |
| RDX: 14 micron average | 54.0 |
| Triacetin | 4.2 |
| 2-Nitrodiphenylamine | 1.0 |
| Lead Stannate—TDI (Oxidized) | 4.2 |
| Carbon black, added | 0.03 |

Heat of Explosion, cal/gm
Measured Value 1104

| πp at Constant p/r From −40°F to 160°F | Pressure Exponent, 70°F Press. range, psi | Slope, "n" |
|---|---|---|
| | 800–1000 | 0.00 |
| | 1000–1700 | 0.40 |

| Press. at 70°F | p/r | πp, %/°F |
|---|---|---|
| 1000 | 2500 | 0.045 |

DATA RELATING TO FIG. 4

| INGREDIENTS | PERCENT COMPOSITION |
|---|---|
| Nitrocellulose, 12.6% N | 19.9 |
| Nitroglycerin | 16.7 |
| RDX: 14 micron average | 54.0 |
| Triacetin | 4.2 |
| 2-Nitrodiphenylamine | 1.0 |
| Lead Stannate—TDI (Reduced) | 4.2 |
| Carbon Black, added | 0.03 |

Heat Of Explosion, cal/gm
Measured Value 1145

| πp at Constant p/r From −40°F to 160°F | Pressure Exponent, 70°F Press. range, psi | Slope, "n" |
|---|---|---|
| | 800–1200 | 0.00 |

| Press. at 70°F | p/r | πp, %/°F |
|---|---|---|
| 1000 | 2080 | 0.02 |

DATA RELATING TO FIG. 5

| INGREDIENTS | PERCENT COMPOSITION |
|---|---|
| Nitrocellulose, 12.6% N | 20.0 |
| Nitroglycerin | 15.0 |
| HMK: 75% 180 micron, 25% 2 micron | 56.0 |
| Triacetin | 4.0 |
| 2-Nitrodiphenylamino | 1.0 |
| Lead Stannate—TDI (Oxidized) | 4.0 |
| Carbon black, added | 0.03 |

Heat of Explosion, cal/gm
Measured Value 1143

| πp at Constant p/r From −40°F to 160°F | Pressure Exponent, 70°F Press. range, psi | Slope, "n" |
|---|---|---|

-continued

| | | |
|---|---|---|
| | 800–1300 | 0.23 |

| Press. at 70°F | p/r | πp, %/°F |
|---|---|---|
| 1000 | 1920 | 0.09 |

DATA RELATING TO FIG. 6

| INGREDIENTS | PERCENT COMPOSITION |
|---|---|
| Nitrocellulose, 12.6% N | 20.0 |
| Nitroglycerin | 15.0 |
| HMK: 75% 180 micron, 25% 2 micron | 56.0 |
| Triacetin | 4.0 |
| 2-Nitrodiphenylamine | 1.0 |
| Lead Stannate—TDI (Reduced) | 4.0 |
| Carbon black, added | 0.03 |

Heat Of Explosion, cal/gm
Measured Value 1143

| πp at Constant p/r From −40°F to 160°F | Pressure Exponent, 70°F Press. range, psi | Slope, "n" |
|---|---|---|
| | 1000–1500 | 0.14 |

| Press. at 70°F | p/r | πp, %/°F |
|---|---|---|
| 1000 | 1650 | 0.12 |

DATA RELATING TO FIG. 7

| INGREDIENTS | PERCENT COMPOSITION |
|---|---|
| Nitrocellulose, 12.6% N | 20.0 |
| Nitroglycerin | 15.0 |
| HMX: 2 micron average | 56.0 |
| Triacetin | 4.0 |
| 2-Nitrodiphenylamine | 1.0 |
| Lead stannate—TDI (Oxidized) | 4.0 |
| Carbon black, added | 0.03 |

Heat of Explosion, cal/gm
Measured Value 1144

| πp at Constant p/r From −40°F to 160°F | Pressure Exponent, 70°F Press, range, psi | Slope, "n" |
|---|---|---|
| | 600–1300 | 0.11 |

| Pres. at 70°F | p/r | πp, %/°F |
|---|---|---|
| 1000 | 2380 | 0.05 |

DATA RELATING TO FIG. 8

| INGREDIENTS | PERCENT COMPOSITION |
|---|---|
| Nitrocellulose, 12.6% N | 20.0 |
| Nitroglycerin | 15.0 |
| HMX: 2 micron average | 56.0 |
| Triacetin | 4.0 |
| 2-Nitrodiphenylamine | 1.0 |
| Lead stannate—TDI (Reduced) | 4.0 |
| Carbon black, added | 0.03 |

Heat of Explosion, cal/gm
Measured Value 1137

| πp at Constant p/r From −40°F to 160°F | Pressure Exponent, 70°F Press. range, psi | Slope, "n" |
|---|---|---|

| Press. at 70°F | p/r | πp, %/°F |
|---|---|---|
| 1000 | 1850 | 0.07 |

DATA RELATING TO FIG. 9

| INGREDIENTS | PERCENT COMPOSITION |
|---|---|
| Fluid Ball Powder, Type B | 18.5 |
| Fluid Ball Powder, Type C | 1.0 |
| Casting Solvent | 46.5 |
| HMX, 2μ | 30.0 |
| Lead Stannate hydrate | 4.0 |

| πp at Constant p/r From −40°F to 160°F | Pressure Exponent, 70°F Press. Range, psi | Slope "n" |
|---|---|---|
| | 1000–1800 | 0.40 |

| Press. at 70°F | p/r | πp %/°F |
|---|---|---|
| 1000 | 2500 | 0.23 |

DATA RELATING TO FIG. 10

| INGREDIENTS | PERCENT COMPOSITION |
|---|---|
| Fluid Ball Powder, Type B | 18.5 |
| Fluid Ball Powder, Type C | 1.0 |

-continued

| | |
|---|---|
| Casting Solvent | 46.5 |
| HMX, 2μ | 30.0 |
| 2,4-tolyene diisocyanate, added | 1.5 |
| Resorcinol, added | 0.5 |
| Load Stannate hydrate | 4.0 |

| πp at Constant p/r From −40°F to 160°F | Pressure Exponent, 70°F Press. range, psi | Slope, "n" |
|---|---|---|
| | 400–3000 | 0.61 |

| Press. at 70°F | p/r | πp, %/°F |
|---|---|---|
| 1000 | 3300 | 0.44 |

DATA RELATING TO FIG. 11

| INGREDIENTS | PERCENT COMPOSITION |
|---|---|
| Ball Powder, Type B | 18.5 |
| Ball Powder, Type C | 1.0 |
| Casting Solvent | 46.5 |
| HMX, 2μ | 30.0 |
| Ballistic Modifier | 4.0 |

| FORMULATION | BALLISTIC MODIFIER |
|---|---|
| (a) | Lead Stannate—TDI (reduced) |
| (b) | Lead Stannate—TDI (oxidized) |
| (c) | Lead Stannate hydrate Heated at 450–500°C for one hour |
| (d) | Lead Stannate hydrate |
| (e) | Lead Stannate—TDI Complex |

DATA RELATING TO FIG. 12

| INGREDIENTS | PERCENT COMPOSITION |
|---|---|
| Fluid Ball Powder, Type B | 18.5 |
| Fluid Ball Powder, Type C | 1.0 |
| Casting Solvent | 46.5 |
| HMK, 2μ | 30.0 |
| Lead Stannate—TDI (Oxidized) | 4.0 |

| πp at Constant p/r From −40°F to 160°F | Pressure Exponent, 70°F Press. range, psi | Slope, "n" |
|---|---|---|
| | 800–1600 | 0.06 |

| Press. at 70°F | p/r | πp, %/°F |
|---|---|---|
| 1000 | 2325 | 0.11 |

DATA RELATING TO FIG. 13

| INGREDIENTS | PERCENT COMPOSITION |
|---|---|
| Fluid Ball Powder, Type B | 18.5 |
| Fluid Ball Powder, Type C | 1.0 |
| Casting Solvent | 46.5 |
| HMK, 2μ | 30.0 |
| Lead Stannate—TDI (Reduced) | 4.0 |

| πp at Constant p/r From −40°F to 160°F | Pressure Exponent, 70°F Press. range, psi | Slope, "n" |
|---|---|---|
| | 800–1600 | 0.00 |

| Press. at 70°F | p/r | πp, %/°F |
|---|---|---|
| 1000 | 2270 | 0.071 |

DATA RELATING TO FIG. 14

| INGREDIENTS | PERCENT COMPOSITION |
|---|---|
| Fluid Ball Powder, Type B | 18.5 |
| Fluid Ball Powder, Type C | 1.0 |
| Casting Solvent | 46.5 |
| HMK, 2μ | 30.0 |
| 2,4-tolylene diisocyanate, added | 1.5 |
| Resorcinol, added | 0.5 |
| Lead Stannate—TDI (Oxidized) | 4.0 |

| πp at Constant p/r From −40°F to 160°F | Pressure Exponent, 70°F Press. Range, psi | Slope, "n" |
|---|---|---|
| | 1000–1800 | 0.16 |

| Press. at 70°F | p/r | πp, %/°F |
|---|---|---|
| 1000 | 2500 | 0.14 |

DATA RELATING TO FIG. 15

| INGREDIENTS | PERCENT COMPOSITION |
|---|---|
| Fluid Ball Powder, Type B | 18.5 |
| Fluid Ball Powder, Type C | 1.0 |
| Casting Solvent | 46.5 |

-continued

| | |
|---|---|
| HMK, 2μ | 30.0 |
| 2,4-tolylene diisocyanate, added | 1.5 |
| Resorcinol, added | 0.5 |
| Lead Stannate—TDI (Reduced) | 4.0 |

| πp at Constant p/r From −40°F to 160°F | | Pressure Exponent, 70°F Press. Range, psi | Slope, "n" |
|---|---|---|---|
| Press. at 70°F | p/r | πp, %/°F | |
| 1000 | 2220 | 0.22 | |

DATA RELATING TO FIG. 16

| INGREDIENTS | PERCENT COMPOSITION | | | | |
|---|---|---|---|---|---|
| | 1A | 2A | 3A | 4A | 7A |
| Ball Powder, Type B | 18.5 | 18.5 | 18.5 | 18.5 | 18.5 |
| Ball Powder, Type C | 1.0 | 1.0 | 1.0 | 1.0 | 1.0 |
| Casting Solvent | 46.5 | 46.5 | 46.5 | 46.5 | 46.5 |
| HMX, 2 | 33.0 | 32.0 | 31.0 | 30.0 | 27.0 |
| Lead Stannate—TDI (Oxidized) | 1.0 | 2.0 | 3.0 | 4.0 | 7.0 |

DATA RELATING TO FIG. 17

| INGREDIENTS | PERCENT COMPOSITION | | | | |
|---|---|---|---|---|---|
| FORMULATION | 1B | 2B | 3B | 4B | 7B |
| Ball Powder, Type B | 18.5 | 18.5 | 18.5 | 18.5 | 18.5 |
| Ball Powder, Type C | 1.0 | 1.0 | 1.0 | 1.0 | 1.0 |
| Casting Solvent | 46.5 | 46.5 | 46.5 | 46.5 | 46.5 |
| HMX, 2μ | 33.0 | 32.0 | 31.0 | 30.0 | 27.0 |
| Lead Stannate—TDI (Reduced) | 1.0 | 2.0 | 3.0 | 4.0 | 7.0 |

I claim:

1. A combustion catalyst for nitrocellulose base propellants for reducing the burning rate dependency of the propellant to variations of pressure and temperature, which comprises a product obtained by reacting lead stannate hydrate and 2,4-tolylene diisocyanate to produce a reaction product and thereafter sintering said reaction product.

2. The catalyst as described in claim 1 wherein said lead stannate-2,4-tolylene diisocyanate reaction product is sintered in the presence of air.

3. The catalyst as described in claim 1 wherein said lead stannate-2,4-tolylene diisocyanate reaction product is sintered essentially in the absence of air.

4. The catalyst according to claim 3, wherein the reaction product of lead stannate hydrate and 2,4-tolylene diisocyanate is sintered at about 500° ± 25°C.

5. The product according to claim 4, wherein the reaction product of lead stannate hydrate and 2,4-tolylene diisocyanate contains between about 17% and 25% by weight of organic matter.

6. The catalyst according to claim 2, wherein the reaction product of lead stannate hydrate and 2,4-tolylene diisocyanate is sintered at about 500° ± 25°C.

7. The product according to claim 6, wherein the reaction product of lead stannate hydrate and 2,4-tolylene diisocyanate contains between about 17% and 25% by weight of organic matter.

* * * * *